US006435386B2

(12) United States Patent
Scott

(10) Patent No.: US 6,435,386 B2
(45) Date of Patent: Aug. 20, 2002

(54) DEVICE FOR GARMENT DESIGN

(75) Inventor: Ian D. Scott, London (GB)

(73) Assignee: Marks and Spencer p.l.c., London (GB)

( * ) Notice: Subject to any disclaimer, the term of this patent is extended or adjusted under 35 U.S.C. 154(b) by 0 days.

(21) Appl. No.: 09/731,203

(22) Filed: Dec. 7, 2000

(30) Foreign Application Priority Data

Dec. 7, 1999 (GB) ..... 9928945
Aug. 25, 2000 (GB) ..... 0021059

(51) Int. Cl.[7] ..... D06C 15/00
(52) U.S. Cl. ..... 223/66
(58) Field of Search ..... 73/37.5, 159; 223/66, 223/98; 33/552, 561, 2 R, 6, 8, 561.1

(56) References Cited

U.S. PATENT DOCUMENTS 4,417,401 A * 11/1983 Aisaka et al. ..... 33/175

* cited by examiner

*Primary Examiner*—Rodney M. Lindsey
*Assistant Examiner*—James G Smith
(74) *Attorney, Agent, or Firm*—Finnegan, Henderson, Farabow, Garrett & Dunner, L.L.P.

(57) ABSTRACT

Device for assessing the likely fit of a garment on a wearer, the device comprising a support shaped to resemble a body part onto which the garment is to be fitted, an artificial tissue layer and at least one pressure sensor, the arrangement being such that the pressure sensor can detect and measure pressure exerted by a garment on the artificial tissue layer.

22 Claims, 1 Drawing Sheet

DEVICE FOR GARMENT DESIGN

Figure 1:
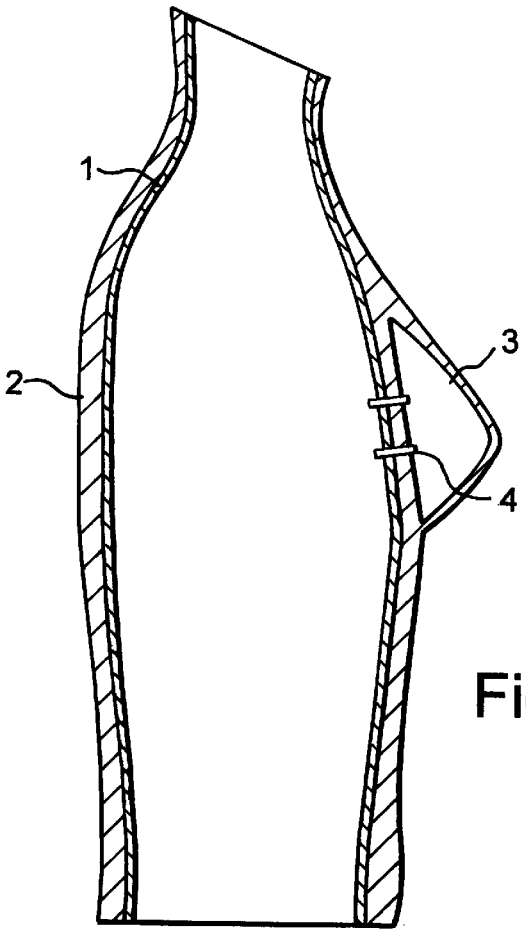

The present invention relates to a device which assists in the design of new garments.

Clothing is usually designed to fit, and sometimes to support the human body. However, during the design stages of clothing development, there is currently no straightforward numerical and objective means of assessing fit and support.

For example, with respect to the design of bras, current methodology uses an iterative process. The bra design is tested on human models, then modified and retested, until the design is deemed correct. Such a "test-modify-retest" loop considerably adds to the time needed for a design to be finalized.

The present invention set out to address this design limitation.

Accordingly, in a first aspect, the present invention provides a design for assessing the potential fit of a garment on a wearer, the device comprising a support shaped to resemble a body part onto which the garment is to be fitted, an artificial tissue layer and at least one pressure sensor, the arrangement being such that the pressure sensor can detect and measure pressure exerted by a garment on the artificial tissue layer.

Preferably the support is formed from a relatively rigid material such as polyurethane or glass fibre reinforced plastic materials and generally takes the shape of the body part around which the garment is designed to fit. The support preferably forms an inner shell onto which the artificial tissue layer can be added. Any suitable material may be used in the construction of the support, with materials that can be rotationally moulded being particularly preferred. Rotational moulding offers a hollow form suitable for housing any electronic components of the invention.

The artificial tissue layer is suitably designed to mimic the human skin, subcutaneous skeletal and muscular structure, such that the support and the artificial layer together mimic a human wearer of a garment in a realistic manner. Preferably, the combination of artificial tissue layer and support is chosen such that the pressure exerted on the artificial tissue layer in comparison with that tested on a live model will have a correlation coefficient of approximately +0.7, more preferably +0.8, with +0.9 or above particularly preferred. The correlation coefficient is a number between −1 and +1. If the correlation is +1, the variables always increase or decrease exactly together, if −1, one variable increases when the other decreases; if 0, the two variables vary independently. The partial correlation indicates that each variable "causes" some of the variation in the other which is, in theory, the square of the coefficient. Thus, a correlation of +0.9 indicates that 81% of the variation in one variable is shared by the other.

Any suitable material may be used form forming the artificial tissue layer and or other components of the model human body, to provide an artificial tissue layer and support combination which allows a realistic assessment of the pressure exerted on the human skin by a garment.

We prefer that the artificial tissue layer is silicone rubber with, optionally, a suitable proportion of silicone oil added to the mix to soften it, in order to render the layer more lifelike. Where silicone oil is added, the addition proportion is preferably up to 50% by weight of the artificial tissue layer, with a figure of 30% by weight being most preferred. It is further preferred to bond the silicone rubber to the support, which helps prevent sagging of the artificial tissue layer. The bond made be made by any suitable means, such as an adhesive or staple, for example. Other suitable bonding means will be readily apparent to the person skilled in the art.

The artificial tissue layer is generally of a thickness that corresponds to the relevant human body part, suitably between 4 mm and 40 mm. However, certain areas of the body may require a layer of a different thickness to be used to allow realistic pressure assessment. A tissue layer of approximately 1 mm–6 mm thickness is preferred for the breasts, for example, in particular 2–4 mm thickness, with 2, 3 or 4 mm most preferred.

Realistic modelling of the breasts is particularly important in the specific case of bra design. Preferably, the breasts have an outer thin artificial tissue layer of polyurethane film or silicone rubber, and contents of silicone gel. This construction mimics that of prosthetic breasts, the difference being that the breasts are moulded to a specific shape rather than a generic one. Silicone gel is a standard component of prosthetic breasts, and is readily available, with WACKER™ silgel 612 being preferred. Commercially available silicone gels are commonly supplied with separate polymer and crosslinking components. The polymer is preferably a vinyl terminated silicone polymer, and crosslinking suitably achieved by using a hydrogen functional crosslinker and platinum catalyst. The profile and the stiffness of the artificial breast can be varied by changing the ratio of such a polymer and cross linker used in the breast construction, to provide a suitable model for clothing to be fitted. The ratio of polymer and cross linker may be readily varied by the skilled person to obtain a lifelike device. Additionally, silicone oil may be added to the polymer/cross linker mix if required.

Breast modelling may be generally carried out by casting the artificial tissue layer, such as the silicone rubber, around the support and one or two attached formers having approximately the same shape of the breasts. During the process, the material forming the tissue layer is cast into a mould which surrounds the support. The mould is treated so that there is no adhesion with the artificial tissue layer, whilst the support is preferably treated with a primer, to allow the artificial tissue layer to bond to the support.

The breast formers are suitably made of a material such as wax which melts at a temperature higher than ambient temperature, but below that at which the structure of the support or artificial tissue layer are altered. Moulding is thus by the well-known lost wax process: heating of the breast model allows the wax, for example, to melt and be removed without affecting the artificial tissue layer or support. The wax may then be replaced by another material, preferably silicone gel or silicone gel with silicone oil, which gives a suitably realistic breast and breast movement.

Any suitable pressure sensing means may be used. For example, the pressure sensor may comprise a hollow cell, containing air, the air space in the cell being connected by a tube to a pump which supplies air to the cell. Pressure exerted by the garment on the air within the cell and tube may be detected, to give an indication of pressure exerted upon the artificial tissue layer. Alternatively, pressure may be measured by cells containing a liquid, or by an electrical detector, such as a piezo-electric device or a capacitance device. Other suitable pressure detecting means will be well known to the skilled person. The pressure sensing device is preferably a substantially flat sensor, which gives little or no distortion of the interface between the garment and the artificial tissue layer.

Pressure sensors are suitably located on the artificial tissue layer, between the surface of the layer and the garment to be tested. Alternatively, the sensors may be located under the artificial tissue layer, if this allows a suitable assessment of pressure to be made.

Preferably the pressure sensors are not in fixed positions on the support or artificial tissue, but are capable of being moved such that they are fully covered by a garment that is being tested. In this way, the sensors measure accurately the pressure exerted upon the artificial tissue layer. Fixed sensors may not be fully covered by a garment and may give inaccurate readings. Moreover, a greater number are required in order to ensure that sufficient numbers of sensors are producing data.

Accordingly, in a preferred aspect, the invention relates to an artificial torso which replicates the human form in such a way that enables garments to be fitted giving an indication via electrical signals as to the comfort level of the garment.

The present invention may be used for fitting garments to any part of the body, but is of particular use in the fitting of bras.

In order to prepare suitably realistic support and artificial tissue layer combinations, we prefer that the design of the support and artificial tissue layer is based upon detailed measurements from human subjects. Preferably, detailed bone measurements of the subjects are taken using an anthropometer or a 3D co-ordinate measuring machine. Measurements may also be suitably made using ultrasound scanning of human tissue, to determine tissue thickness, for example. The measurements are suitably taken at defined positions, and at predetermined respiratory phases such as normal inspiration and expiration and maximum inspiration and expiration points. It is also possible to use 3D body scanning technology to obtain detailed surface measurements. Using such measurements, a template for the support may be made, such as a paper or foam template, or both. A final support may be built from, for example, the foam template. Further refinement of the model may be carried out with additional measurement of the subjects In the specific example of bra design, data concerning breast volumes, torso circumferences, and profiles of supported and unsupported breasts may be utilised to provide further refinement. Moreover, the movement of breasts during movement, such as walking, may be measured and utilised in the production of the support, in order to obtain realistic pressure data for the garment in use. Preferably, the time/displacement curves for different body parts may be analysed using accelerometers, or motion analysis systems, alone or in combination with computer modelling techniques to ascertain the best shape for the support and artificial tissue layer combination.

Furthermore, a cam and motor, linear motor or hydraulic system may be used in combination with the device of the present invention in order to match the movement of the live model. This provides further data on the pressure exerted by the garment during use.

Accordingly, the present invention further relates to a method for designing a device for assessing the likely fit of a garment on a human wearer comprising a support and artificial tissue layer, the method comprising the steps of measuring a human subject to determine suitable dimensions for the support and artificial tissue layer, construction of a support and artificial tissue layer to those dimensions, and refinement of the design by comparison of the pressure exerted on the artificial tissue layer of the support with pressure exerted on the skin of human subjects, in order to modify the support to be more like the human subjects. Preferably, the correlation between the pressure data in human subjects and the artificial tissue layer model is generally equal to or more than +0.7, more preferably +0.8 and most preferably +0.9 or above.

The present invention also relates to a method for measuring the likely fit of a garment, comprising testing the garment on a device as previously defined, and measuring the pressure exerted by the device on the artificial tissue layer.

In addition, the invention relates to a process for the manufacture of garments, comprising the steps of:

a measuring the pressure exerted by a garment on the artificial tissue layer of the device of the invention;

b altering the garment, if necessary, to vary the pressure and obtain the desired garment fit, thus forming a template garment, and c copying the template garment to produce articles to the same design.

The invention also extends to the situation in which the dimensions and coordinates of the template garment are used in the mass production of garments to the template design.

The present invention also relates to template garments produced by the present invention, and use of the template garment and/or device of the present invention in a quality control or audit process. In such a quality control process the article manufactured in accordance with the design of the original template article is tested on the device of the invention, or against the template article, at the last stage in the process. This ensures that all articles are made to the correct shape and fit, and are in conformity with the template garment pressure measurements.

As such, the invention particularly relates to a process for the manufacture of garments as defined above, additionally comprising the step:

d testing a proportion of a batch of articles so produced on a device of the present invention, to ensure correct manufacture and fit.

Figure 2:
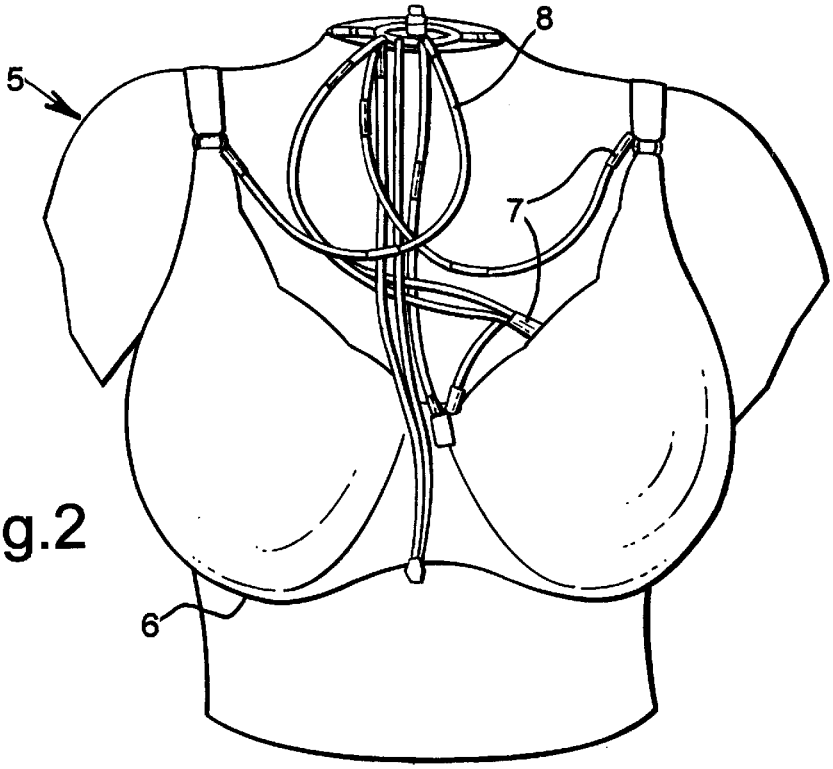

The present invention is now illustrated with respect to the following Example and Figures, which is not limiting upon the present invention, wherein FIG. 1 is a sketch of a female torso assembled according to the present invention; and FIG. 2 is a photograph of a device according to the present invention.

EXAMPLE 1

An embodiment of the invention was built as follows:

A human model of known clothing size was selected according to measurements in certain key dimensions, then a life-cast of her torso was created in plaster, life-casting being an established technique available, for example, in sculpture departments at Universities.

Skin tissue thickness was measured on the model in 10 places around the shoulder, side and back, using an ultrasound scanner. Ultrasound scanners are widely used in medicine and may be obtained from medical electronics suppliers. The tissue thickness locations were so chosen as to map the areas of the body which may lie under the straps of bras.

The individual tissue thickness data were extended into a contour plot of the whole torso, extrapolating from the point data by linking points of approximately equal thickness. The whole surface of the torso, apart from the breasts, was then assigned thickness from a menu of 7 discrete thicknesses; 4, 8, 12, 16, 20, 24 and 28 mm.

A cast was made in the plaster mould of the torso, then a mould was made from the cast, thus defining the outer surface of the torso. The mould was then lined with wax in various thicknesses corresponding to the various tissue thicknesses assigned. Sheet wax is available for such purposes from moulding suppliers. Then the wax was smoothed to make the transitions gradual.

A cast was then made into the waxed mould, creating a smaller cast corresponding to the 'bony core' of the model. The breast cavities were sealed off by a flat plate at the level of the surrounding 'rib cage'. A mould was then made from this cast, and a rotationally moulded bony core was produced in polyurethane. The wax was then removed from the outer mould.

An assemblage was then constructed in which the polyurethane bony core was mounted within the outer mould, carefully and rigidly positioned to reproduce the original relative positions of the two, thereby leaving a hollow space around the bony core corresponding to the skin and soft tissue of the model.

A moulding compound (such as silicone rubber) was injected into this space, then after curing the outer mould was removed. The moulded breasts were then cut away from the torso, and a mould made around each one.

The breast moulds were then lined with wax, to a thickness of 20 mm on the side which connects to the chest wall, and to 3 mm on the outer side. A cast was then made in the lined moulds, using Jesmonite, a very hard and durable casting compounds. Three M8 threaded inserts were placed in the mould on the chest wall side, so that they were incorporated into the cast. Such inserts, and Jesmonite, are available from general moulding suppliers. The casts were then referred to as the 'breast former'.

The breast formers were moulded, and wax casts made in the moulds. The wax breast formers were mounted rigidly to the bony core, bolting to the threaded inserts via 20 mm spacers, so creating a gap 20 mm wide between the bony core and the chest-wall side of the breast formers. The bolts were made of M8 threaded rod, drilled through with a 5 mm bore, finished on the outer end with a large drilled washer and clamped using a nut at either end.

The moulds and formers were assembled, then the voids filled with a mixture of a soft grade of silicone rubber and silicon oil, in the ratio 70% rubber and 30% oil. Silicone rubber of appropriate specification is available from specialist suppliers, to a specification comprising high tear strength with low hardness.

After the rubber had cured, the assembly was heated to melt the wax, which was drained out of the breast cavities through the 5 mm bore in the mounting bolts.

The breast cavities were then filled with silicone gel as disclosed above, through the bores, and the bores plugged.

The torso assembly thus comprised a hollow bony core, silicone rubber skin of varying thickness, and breasts with a gel filling and silicone rubber skin.

The present-measurement system was fitted to the torso assembly, and comprised 16 plastic cells containing silicone oil, each attached via a plastic tube to a piezeo-electric transducer. The transducers were housed in a box fitted into the hollow interior of the bony core, each having its own amplifier to raise the signal voltage from a few millivolts to a signal between 0 and 5 volts. The amplified signal was passed to an analogue-to digital converter card in a computer, then passed to a computer program as disclosed above. Such electronics and computing systems are well known and can be supplied by electronics consulting firms and computer programmers.

FIG. 1 is a sketch of a female torso assembled according to the present invention, suitable for the fitting of bras and other underclothes. The hollow bony core 1 has a 'skin' layer 2. The breast cavity 3, has fastening/tubes 4 for wax removal/filling, as described above.

In FIG. 2, the device manufactured according to the above protocol is illustrated. The torso 5 is used to model a bra 6. Pressure sensors 7 extend from the neck of the torso, from within the hollow core, and can be located at different positions by virtue of the moveable plastic tubes 8 to which they are attached.

What is claimed is:

1. A process for the manufacture of garments, comprising the steps of:

providing a device comprising a support shaped to resemble a body part and an artificial tissue layer;

fitting a garment on the device;

measuring pressure exerted by the garment on the artificial tissue layer of the device;

altering the garment, if necessary, to vary the pressure and obtain a desired garment fit, thus forming a template garment; and copying the template garment to produce at least one article to the same design of the template garment.

2. A process according to claim 1, further comprising the step of testing a proportion of a batch of the article so produced to ensure correct manufacture and fit.

3. A process according to claim 1, wherein the support of the device is formed from a relatively rigid material.

4. A process according to claim 3, wherein the relatively rigid material is polyurethane.

5. A process according to claim 3, wherein the relatively rigid material is glass fibre reinforced plastics.

6. A process according to claim 1, wherein the support of the device is formed into an inner shell onto which the artificial tissue layer can be added.

7. A process according to claim 1, wherein the artificial tissue layer is prepared such that the pressure exerted on the artificial tissue layer in comparison with the pressure exerted on a human being has a correlation coefficient of at least +0.7.

8. A process according to claim 1, wherein the artificial tissue layer is prepared such that the pressure exerted on the artificial tissue layer in comparison with the pressure exerted on a human being has a correlation coefficient of at least +0.8.

9. A process according to claim 1, wherein the artificial tissue layer is prepared such that the pressure exerted on the artificial tissue layer in comparison with the pressure exerted on a human being has a correlation coefficient of at least +0.9.

10. A process according to claim 1, wherein the artificial tissue layer of the device is formed from silicone rubber.

11. A process according to claim 10, wherein silicone oil is added to the silicone rubber.

12. A process according to claim 11, wherein the proportion of the silicone oil is up to 50% by weight of the artificial tissue layer.

13. A process according to claim 12, wherein the proportion of the silicone oil is 30% by weight of the artificial tissue layer.

14. A process according to claim 10, wherein the silicone rubber is bonded to the support.

15. A process according to claim 1, wherein the artificial tissue layer is between 2 mm and 40 mm thick.

16. A process according to claim 1, further comprising the step of providing a portion shaped to resemble a human female breast and the artificial tissue layer having a thickness between 2–4 mm at the portion shaped to resemble the human female breast.

17. A process according to claim 1, further comprising the step of providing a portion shaped to resemble a human female breast having an outer thin artificial tissue layer and silicone gel contained within the outer thin artificial tissue layer.

18. A process according to claim 17, wherein the outer thin artificial tissue layer is formed from polyurethane film.

19. A process according to claim 18, wherein the outer thin artificial tissue layer is formed from silicon rubber.

20. A process according to claim 1, wherein the measuring step comprises the step of locating at least one flat pressure sensor between the artificial tissue layer and the garment to be tested.

21. A process for the manufacture of garments, comprising the steps of:

providing a device comprising a support shaped to resemble a body part and an artificial tissue layer;

fitting a garment on the device;

measuring pressure exerted by the garment on the artificial tissue layer of the device; and altering the garment, if necessary, to vary the pressure and obtain a desired garment fit, thus forming a template garment.

22. A process according to claim 21, further comprising the step of copying the template garment to produce at lease one article having the same design of the template garment.

* * * * *

UNITED STATES PATENT AND TRADEMARK OFFICE

CERTIFICATE OF CORRECTION

PATENT NO. : 6,435,386 B2
DATED : August 20, 2002
INVENTOR(S) : Ian D. Scott et al.

It is certified that error appears in the above-identified patent and that said Letters Patent is hereby corrected as shown below:

Column 7,
Line 12, “silicon” should read -- silicone --.

Column 8,
Line 13, “lease” should read -- least --.

Signed and Sealed this

Third Day of December, 2002

JAMES E. ROGAN
*Director of the United States Patent and Trademark Office*